US008342610B2

(12) United States Patent
Marsic et al.

(10) Patent No.: US 8,342,610 B2
(45) Date of Patent: Jan. 1, 2013

(54) GREEN CONCRETE SAW

(75) Inventors: Martin D. Marsic, Highland Heights, OH (US); Jeffrey A. Gray, LaGrange, OH (US)

(73) Assignee: Diamond Products, Limited, Elyria, OH (US)

( * ) Notice: Subject to any disclaimer, the term of this patent is extended or adjusted under 35 U.S.C. 154(b) by 523 days.

(21) Appl. No.: 12/507,204

(22) Filed: Jul. 22, 2009

(65) Prior Publication Data

US 2010/0018515 A1 Jan. 28, 2010

Related U.S. Application Data

(60) Provisional application No. 61/082,841, filed on Jul. 23, 2008, provisional application No. 61/148,514, filed on Jan. 30, 2009.

(51) Int. Cl.
*B28D 1/04* (2006.01)

(52) U.S. Cl. ..... 299/39.3; 125/13.03

(58) Field of Classification Search ..... 125/13.01, 125/13.03, 12; 299/39.3, 36.1, 39.1, 39.6; 404/93, 94; *B28D 1/02, 1/04*
See application file for complete search history.

(56) References Cited

U.S. PATENT DOCUMENTS

| | | | | |
|---|---|---|---|---|
| 3,664,393 | A * | 5/1972 | McLeod et al. | 144/117.4 |
| 4,840,431 | A * | 6/1989 | Jedick | 299/39.3 |
| 5,570,677 | A | 11/1996 | Chiuminatta et al. | |
| 5,575,271 | A | 11/1996 | Chiuminatta et al. | |
| 5,579,753 | A | 12/1996 | Chiuminatta et al. | |
| 2004/0159315 | A1 * | 8/2004 | Howard et al. | 125/13.01 |

FOREIGN PATENT DOCUMENTS

FR 1481149 a * 4/1967

* cited by examiner

*Primary Examiner* — Sunil Singh
(74) *Attorney, Agent, or Firm* — Rankin, Hill & Clark LLP

(57) ABSTRACT

A green concrete saw that allows for precise adjustment of a height of a circular saw blade is provided. The saw provides for the circular saw blade to be secured to a front end of a mainframe mounted on an undercarriage. A major height adjustment is performed by adjusting the height of the mainframe relative to the undercarriage. Further, the undercarriage supports wheels for the saw, and a fine height adjustment is performed by adjusting the height of a front end of the undercarriage relative to the ground through the use of an eccentric front axle.

10 Claims, 8 Drawing Sheets

100
102
104
106
108
110
118
120
122
124
126
128
130
134
136
138
140
142
144
147
152
154
156
158
160
162
174
178
180
186
204
224
234

224

GREEN CONCRETE SAW

PRIORITY CLAIM

The present application is based on and claims the priority benefit of Provisional Application Ser. No. 61/082,841 filed on Jul. 23, 2008 and Provisional Application Ser. No. 61/148,514 filed on Jan. 30, 2009, the contents of which are hereby incorporated in full by reference.

BACKGROUND

The present invention relates to a green concrete saw, or a saw for use in cutting grooves into wet concrete. The saw includes a base onto which a circular saw blade and engine are mounted, with a control handle that allows an operator control over the moving direction of the saw. The circular saw blade is rotated by the engine so as to cut grooves along a path of movement of the saw in the green or wet concrete. Accordingly, the base generally includes wheels that allow for easier movement of the saw.

However, conventional green concrete saws are generally limited in their ability to adjust the height of circular saw blade relative to the ground or the wet concrete. As such, it is difficult to control the quality of the grooves cut into the wet concrete. Thus, there is a need for a green concrete saw with improved precision in setting the elevation of the circular saw blade relative to the wet concrete.

SUMMARY

The present invention provides a green concrete saw that overcomes the shortcomings and drawbacks of conventional green concrete saws. Particularly, the green concrete saw provided herein allows the saw blade height to be precisely adjusted by having a major adjust that allows for large scale adjustments of the height of the saw blade, and a fine adjust that allows for smaller scale adjustments of the height of the saw blade.

The green concrete saw provides a mainframe mounted to an undercarriage. The mainframe supports a circular saw blade and the undercarriage supports wheels for moving the saw. The height of the mainframe relative to the undercarriage is adjustable via a major adjust and the height of the undercarriage relative to the ground is adjustable via a fine adjust.

The major adjust can be provided by a rectangular plate having a plurality of stacked horizontal notches defined therein. The plate is rotably secured to a front end of the undercarriage and passes through an opening defined in the mainframe. Each of the notches can receive an edge of the mainframe opening, and by adjusting the notch that receives the edge of the mainframe opening, the height the mainframe relative to the undercarriage is adjusted.

The fine adjust can be provided by an eccentric axle on which the front wheels are mounted. The eccentric axle has ends formed on a central portion, where the ends share a common center point that differs from that of the central portion. Accordingly, by rotating the central portion, the height of the center point of the end portions can be adjusted. By mounting the front wheels on the end portions, the height of the undercarriage relative to the ground can thereby be adjusted. As the mainframe is supported by the undercarriage, the mainframe height relative to the ground is similarly adjusted.

BRIEF DESCRIPTION OF THE DRAWINGS

These and other features will be clear with reference to the appended drawings. Therein.

DETAILED DESCRIPTION

Figure 1:
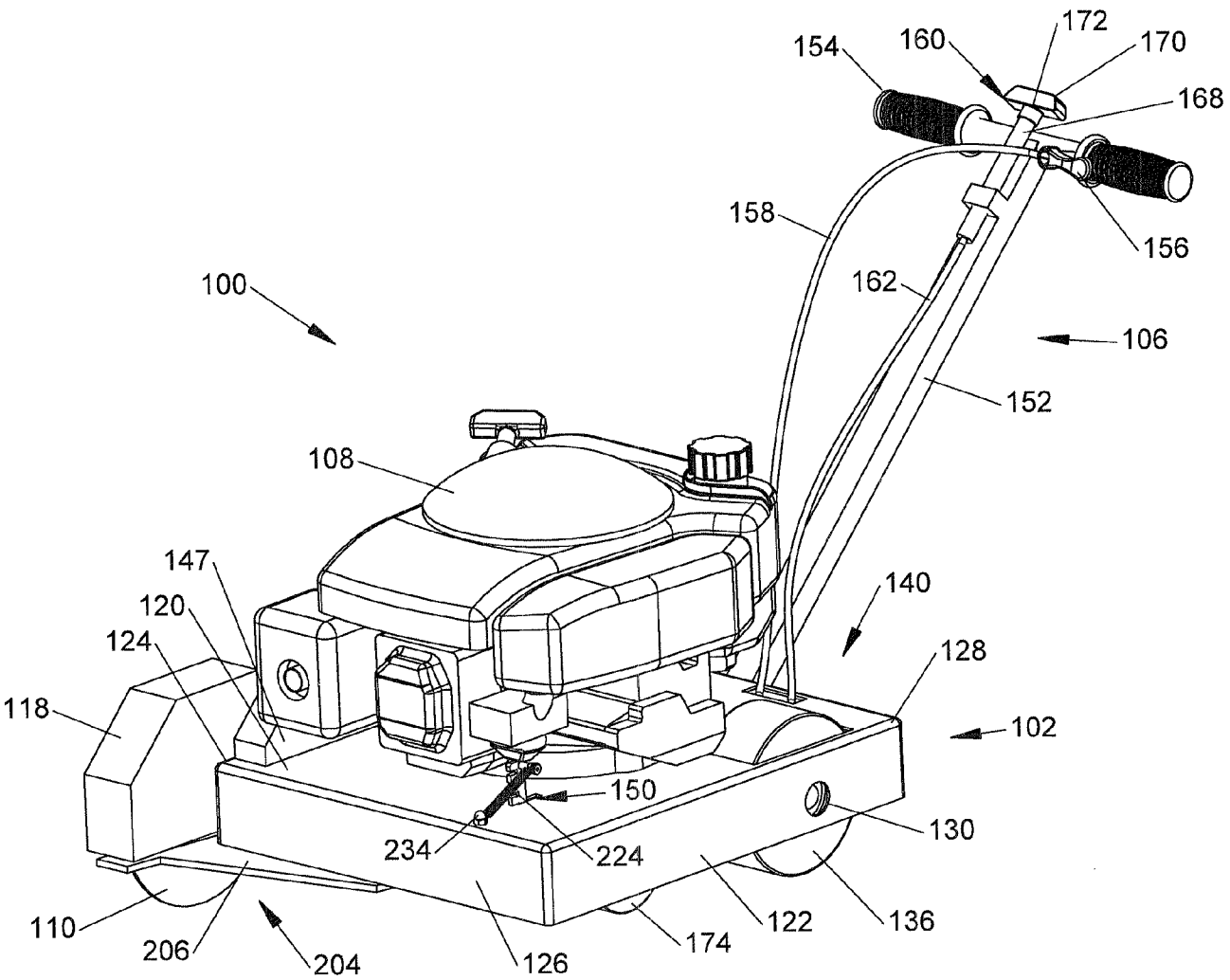
FIG. 1 is a perspective view of a green concrete saw according to the present invention.
Figures 2A, 2B, 2C:
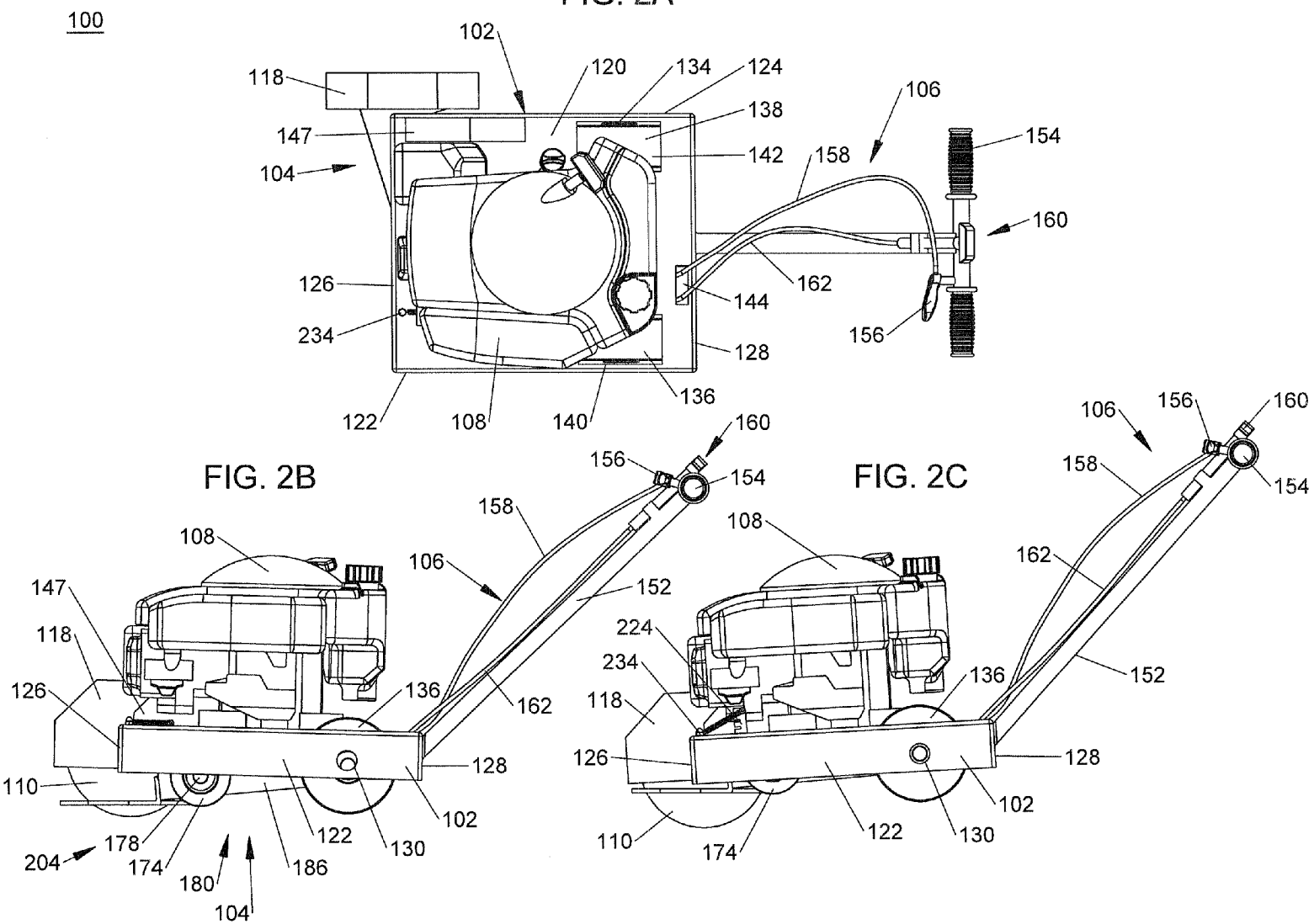
FIG. 2A is a plan view of the green concrete saw according to the present invention.
FIG. 2B is a sectional view of the green concrete saw according to the present invention in an elevated state.
FIG. 2C is a sectional view of the green concrete saw according to the present invention in a lowered state.

The present invention will be described herein with reference to the appended drawings. The description with reference to the drawings is intended to simplify and facilitate the understanding of the invention. Accordingly, a person of ordinary skill in the art would recognize that the present invention is amenable to various modifications while remaining within the scope and spirit of the present disclosure. Further, to the extent practicable, potential modifications considered will be described.

With reference to FIGS. 1, 2A, 2B, and 2C, a green concrete saw 100 for cutting grooves in the surface of wet concrete is shown. The green concrete saw 100 includes a mainframe 102 and an undercarriage 104 pivotally attached to one another, and a control assembly 106 that provides an operator control over the motion of the saw 100 and the relative pivot of the mainframe 102 and undercarriage 104. The control assembly 106 is welded to the mainframe 102 such that the two are rigidly secured to one another.

The mainframe 102 generally serves as a support structure, supporting an engine 108 and a blade 110 that are operably connected to one another via a blade axle and an engine belt. Further, the mainframe supports a blade guard 118 to protect the engine 108 and the blade 110 from the outside environment.

To support these elements, the mainframe 102 is formed of a planar upper surface 120 having a generally rectangular shape that principally supports the engine 108, the blade 110, and the blade guard 118. Left and right side surfaces 122, 124 extend vertically downward from left and right side edges of the upper surface 120, respectively, with front and rear surfaces 126, 128 extending vertically downward from front and rear edges of the upper surface 120, respectively. Accordingly, the mainframe 102 has a shape similar to that of a box top.

A left rear circular hole 130 is defined at a rear portion of the left side surface 122 and a right rear circular hole is defined at a rear portion of the right side surface 124. The circular holes 130 are aligned with one another and are configured to receive a rear axle 134 that supports left and right side rear wheels 136, 138 at end portions of the rear axle 134.

The rear axle 134 has a width substantially equal to a distance between the mainframe left and right side surfaces 122, 124, such that the rear wheels 136, 138 are disposed laterally inside of the mainframe left and right side surfaces 122, 124. To allow the rear wheels 136, 138 to fit, the mainframe upper surface 120 defines left and right side wheel openings 140, 142 that allow the rear wheels 136, 138 to protrude through the upper surface 120.

The mainframe 102 supports the engine 108 such that the engine is attached to a generally central portion of the mainframe upper surface 120. As such, the engine 108 is disposed between the rear wheels 136, 138 and the rear wheel mainframe openings 140, 142. Accordingly, at least at a base of the engine 108, the engine 108 has a width dimension smaller than the spacing between the rear wheels 136, 138. The engine 108 is secured to the mainframe upper surface 120 in a conventional manner, using mechanical fasteners such as screws and nuts and bolts.

The blade 110 and blade guard 118 are attached to a front portion of the right side surface 124 of the mainframe 120. The blade axle (not shown) extends perpendicularly from the center point of the blade 110 and runs adjacent to the front surface 126 of the mainframe 120. The blade axle passes through an axle opening defined in the front portion of the right side surface 124. So as to allow the engine belt to engage the blade axle, a belt hole 145 is formed in the front, right side corner of the mainframe upper surface. The engine belt (not shown) passes through a belt opening 145 in the mainframe and wraps around the blade axle underneath the mainframe upper surface 120. A belt cover 147 is disposed over the belt opening 145, and extends from the mainframe upper surface 120 to the engine 108, thereby covering the engine belt.

The blade 110 extends above and below the mainframe upper surface 120 and beyond a front edge of the mainframe 102. The blade guard 118 has a pair of vertical su, laces that are parallel to the blade 110, with a first vertical surface being flush with the mainframe right side surface 124 and a second vertical surface being disposed on an opposite side of the blade 110. The vertical surfaces of the blade guard 118 extend beyond top and front sides of the blade 110 and are connected to one another via a connecting portion formed by a perpendicular bend from ends of the vertical surfaces. Further, the blade guard 118 has an arc shaped perimeter that ends at a bottom edge of the front surface 126. In all, the blade guard 118 is configured to cover side and top edges of the blade 110.

As mentioned, the blade 110 is a circular saw blade that cuts wet concrete by making contact with the wet concrete during high velocity rotation. The blade 110 is driven by the engine 108, which is operably connected to the blade 110 via the blade axle and the engine belt. The engine 108 used with the saw 100 described herein can be any variety of engine known in the art that is suitable for use to drive the blade 110 at the necessary rotational velocity.

To transfer a rotational force from the engine 108 to the blade 110, the blade axle perpendicularly extends from a center point of the blade 110, where the engine belt wraps around a distal end of the blade axle so as to frictionally engage the blade axle. The engine 108 generates a rotational force that drives the belt, which causes the blade axle to rotate through the frictional engagement therewith. The blade axle is integrated with the blade 110 such that the rotation of the blade axle causes the blade 110 to rotate.

While the engine 108 and other related components are important to the operation of the saw 100, it is noted that these components that are mounted on the mainframe 102 are not necessary in the description of the adjustment of the blade 110 height. As such, the remaining figures only illustrate the mainframe 102 and the blade 110, with the engine 108 and other related components omitted.

Figure 3B:
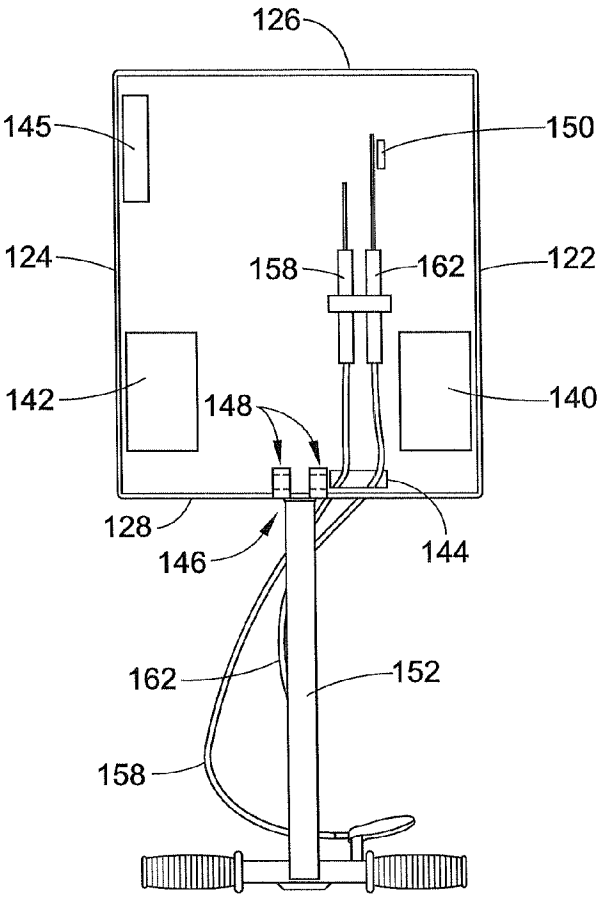
FIG. 3B is a bottom view of the mainframe of the green concrete saw according to the present invention.
Figure 3A:
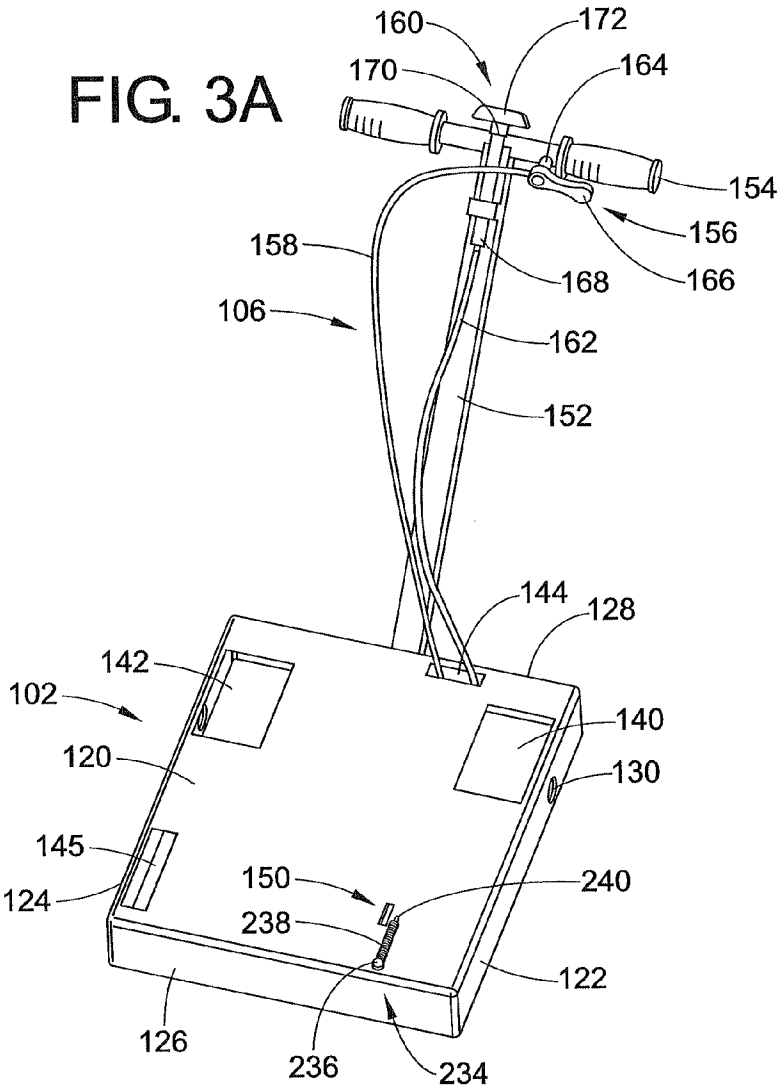
FIG. 3A is a perspective view of a mainframe of the green concrete saw according to the present invention.

In this regard, with reference to FIGS. 3A and 3B, the mainframe 102 and the control assembly 106 are illustrated. Therein, the mainframe 102 includes the upper surface 120, the left side surface 122, the right side surface 124, the front surface 126, and the rear surface 128. Additionally, a pair of pivot plates 146 is provided on the mainframe, an adjustment opening 150 is defined through the mainframe upper surface 120, and a cable opening 144 is defined through the mainframe upper surface 120.

The pivot plates 146 are generally rounded plate members that project from an inside of the rear surface 128 and a central, inside, rear of the mainframe upper surface 120 toward a front of the mainframe 102. The pivot plates 146 are generally vertically oriented such that broad faces of the pivot plates 146 face outward. Aligned mainframe pivot openings 148 are defined through each of the pivot plates 146.

The adjustment opening 150 is a rectangular opening formed through the mainframe upper surface 120 in a position near the front of the mainframe 102, slightly offset to the left of center of the mainframe upper surface 120. A front horizontal edge of the adjustment opening 150 defines an edge that is adapted to engage with a ratcheting plate 224, which will be described in further detail below.

The control assembly 106 is provided to allow the operator to move the saw 100 and to raise and lower the blade 110 of the saw. With particular reference to the raising and lowering of the blade 110, the control assembly 106 allows the operator the ability to perform a major adjust or a fine adjust. To perform these functions, the control assembly includes a handle leg 152, a handle bar 154, a major adjust lever 156, a major adjust cable 158, a fine adjuster 160, and a fine adjust cable 162.

The handle leg 152 proximal end is welded to a central portion of the mainframe rear surface 128 and a rear central portion of the mainframe upper surface 120. The handle leg 152 extends at an upward angle from the mainframe 102 to a desired height, which is preferably approximately level with a hip of an operator. The exact height of the distal end of the handle leg 152 and angle of incline of the handle leg 152 can vary based on operator comfort. Further, the height of the distal end of the handle leg 152 can be fixed upon manufacture or can be adjustable by the operator.

At the distal end of the handle leg 152, the handle bar 154 is secured and extends perpendicularly from each end of the handle leg 152 so as to form a T-shaped arrangement. The handle bar 154 provides the operator a grip point so as to be able to push and steer the saw 100.

The major adjust lever 156 is pivotally mounted on the handle bar 154 to the left of the handle leg 152 so as to extend horizontally substantially parallel with the handle bar 154. The major adjust lever 156 takes a form similar to that of a bicycle hand brake. Accordingly, a base portion 164 that extends outwards from the handle bar 154 includes a pivot point 166 for a proximal end of the major adjust lever 156.

The major adjust lever 156 extends from the base portion 164 toward an end of the handle bar 154 so as to be substantially parallel with the handle bar 154. Accordingly, an operator can easily grip and pull the major adjust lever 156 toward the handle bar 154.

Also at the base portion 164, the major adjust cable 158 is connected to the major adjust lever 156. The major adjust cable 158 is a Bowden cable, having an inner wire inserted in a rubber or plastic sheathing. The sheathing is fixedly connected to the base portion 164 and the inner wire extends therefrom and connects to the major adjust lever 156 such that when the major adjust lever 156 is pulled toward the handle bar 154, the inner wire of the major adjust cable 158 is similarly pulled.

The major adjust cable 158 extends from the base portion 164, through the mainframe cable opening 144, to a position disposed underneath the mainframe 102, and is there secured by the sheathing to an undersurface of the mainframe upper surface 120. Specifically, the sheathing of the major adjust cable 158 is secured to the undersurface of the mainframe upper surface 120 in a position near to but slightly behind the adjustment opening 150. As will be described in further detail below, the inner wire of the major adjust cable 158 is there secured to the ratcheting plate 224.

The fine adjuster 160 is provided in a vertical orientation along the handle leg 152 so as to upwardly project from the distal end of the handle leg 152. Particularly, the fine adjuster 160 is a piston-type device having a hollow cylindrical housing 168 that slidingly receives an adjuster rod 170. The rod 170 is received in a top portion of the housing 168 and can be inserted further into or pulled further from the housing 168. At a top end of the rod 170, a handle 172 is provided to facilitate the user in pushing down and pulling up the rod 170.

The housing 168 provides a locking mechanism for locking the rod 170 into a position within the housing. The locking mechanism preferably operates to lock the rod 170 into any vertical position in the housing 168. One such locking mechanism actuates when the rod 170 is rotated in a locking direction in the housing. Similarly, the rod 170 is unlocked by rotating in an opposite, unlocking direction.

At a bottom end of the housing 168, the fine adjust cable 162 is received. As with the major adjust cable 158, the fine adjust cable 162 is a Bowden cable that has an inner wire wrapped with a sheathing. The sheathing of the fine adjust cable 158 is fixedly secured to the bottom end of the housing 168, and the inner wire of the fine adjust cable 158 extends into the housing 168 and is fixedly secured to a bottom end of the rod 170. Accordingly, the rod 170 pulls the inner wire of the fine adjust cable 162 when the rod 170 is pulled in an upward direction from the housing 168.

The fine adjust cable 158 extends from the fine adjuster housing 168, through the mainframe cable opening 144, to a position disposed underneath the mainframe 102, and is there secured by the sheathing to an undersurface of the mainframe upper surface 120. Specifically, the sheathing of the fine adjust cable 162 is secured to the undersurface of the mainframe upper surface 120 in a position substantially above the undercarriage 104, where the inner wire of the fine adjust cable 162 is secured to an eccentric front axle 178, as will be described in further detail below.

Figure 4A:
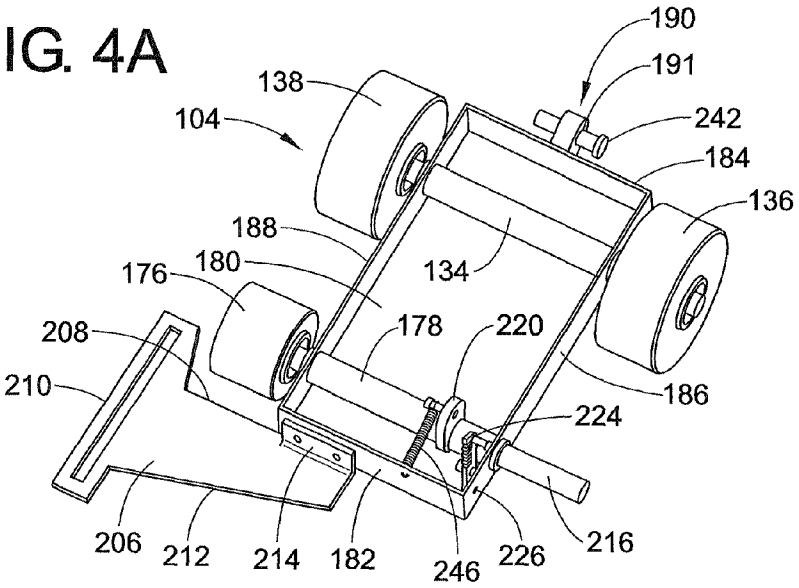
FIG. 4A is a perspective view of an undercarriage of the green concrete saw according to the present invention.
Figure 4B:
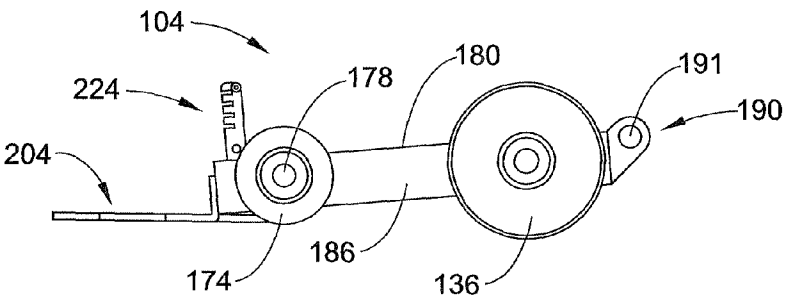
FIG. 4B is a sectional view of the undercarriage of the green concrete saw according to the present invention.
Figure 4C:
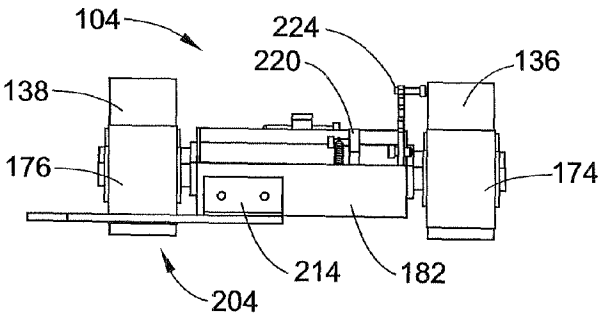
FIG. 4C is a front view of the undercarriage of the green concrete saw according to the present invention.

As mentioned, the mainframe 102 is pivotally secured to the undercarriage 104. As such, the undercarriage 104 generally sits below the mainframe 102 and supports the rear wheels 136, 138 and rear axle 134, as well as left and right front wheels 174, 176, respectively, and the eccentric front axle 178. As shown in FIGS. 4A-4C, the undercarriage 104 includes a base 180 formed of a front wall 182, a rear wall 184, a left wall 186, a right wall 188, and an undercarriage pivot plate 190. The walls 182, 184, 186, 188 are vertically oriented and converge with one another at right angles to form the rectangular shaped base 180. Further, a planar bottom surface (not shown) can be provided to increase the rigidity of the undercarriage base 180.

The undercarriage pivot plate 190 extends rearwardly from a central portion of the undercarriage rear wall 184, and includes a pivot opening 191 defined therethrough. The undercarriage pivot plate 190 has a similarly rounded shape to that of the mainframe pivot plates 146, such that the undercarriage pivot plate 190 fits between the mainframe pivot plates 146 with the three pivot openings 148, 191 aligned.

The undercarriage 104 also supports the saw wheels 136, 138, 174, 176. In this regard, the undercarriage left wall 186 defines a rear axle opening at a rear portion thereof, while the undercarriage right wall 188 defines a rear axle opening in a position corresponding to the undercarriage left wall rear axle opening. Accordingly, the undercarriage 104 receives the rear axle 134 such that the rear axle 134 extends through the undercarriage left wall 186 and the undercarriage right wall 188, and passes through both rear axle openings so as to receive the rear wheels 136, 138 outside of the left and right walls 186, 188 of the undercarriage base 180. As mentioned above, the rear wheels 136, 138 are disposed within the mainframe left and right side surfaces 122, 124.

Additionally, the undercarriage left wall 186 defines a front axle opening at a front portion thereof, while the undercarriage right wall 188 defines a front axle opening in a position corresponding to the undercarriage left wall front axle opening. The eccentric axle 178 extends between the undercarriage left and right walls 186, 188, and passes through the front axle openings defined therein.

The eccentric axle 178 is secured to the right and left front wheels 174, 176 such that the front wheels 146, 148 are disposed outside of the undercarriage left and right walls 186, 188, yet within the mainframe left and ride side surfaces 122, 124. Further, the front wheels 174, 176 have a circumference that is smaller than that of the rear wheels 136, 138. Thus, the undercarriage 180 is tilted slightly forward toward the front wheels 174, 176

The undercarriage 104 also includes a wear plate 204. The wear plate 204 has a triangular-shaped, horizontally aligned skip plate 206, with a rear edge 208 running parallel to and adjacent with the undercarriage base front wall 182, a side edge 210 running parallel to the undercarriage right wall 188 and intersecting the rear edge 208 at a right angle, and a hypotenuse edge 212 connecting a left side corner of the rear edge 208 to a top corner of the side edge 210. The rear edge 208 extends beyond the undercarriage right wall 188 and the right front wheel 176.

Further, a connecting plate 214 extends vertically from the rear edge 208 of the skip plate 206. The connecting plate 214 rests flush against the undercarriage front wall 182, and is secured to the front wall 182. Thus, the wear plate 204 is secured to the undercarriage base 180 through the connection of the connecting plate 214 to the front wall 182. The skip plate 204 and connecting plate 214 (as well as the front wall 182) intersect at an angle that is slightly less than 90°. While the angle of intersection is not severely acute, the angle is preferably in the range of 80° to 87°. However, other angle ranges are considered to be amenable to the saw 100 while remaining within the scope of the invention.

Figure 5:
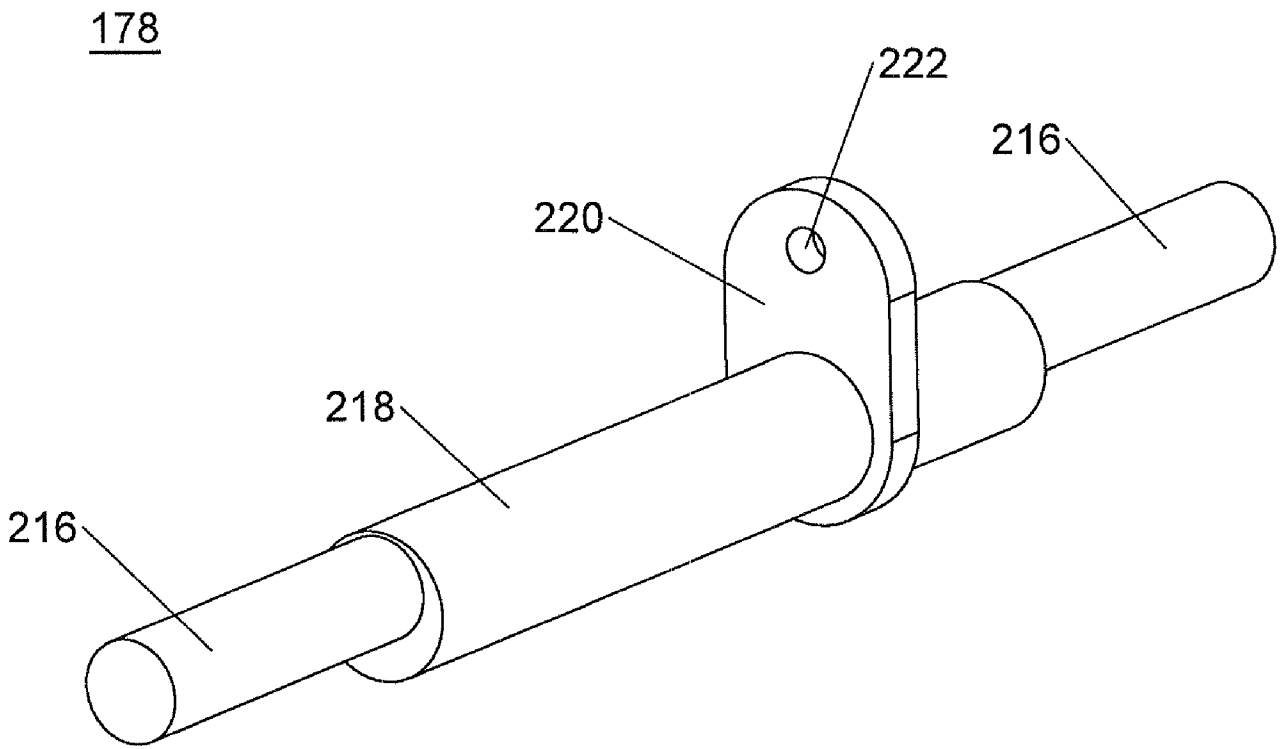
FIG. 5 is a perspective view of an eccentric axle according to the present invention.

With reference to FIG. 5, the eccentric axle 178 is illustrated. The eccentric axle 178 serves as the front axle and has a pair of end portions 216 arranged on opposite ends of a central portion 218, with a linkage plate 220 attached to and extending radially from the central portion 218. Both of the end portions 216 and the central portion 218 are circular in cross section, with the central portion 218 having a greater circumference than the end portions 216. The length of the central portion 218 is less than a distance between undercarriage side walls 186, 188, while a total length of the eccentric axle 178 is greater than a total distance between outside ends of the front wheels 174, 176.

Notably, the eccentric axle end portions 216 have a common center point, with the common center point of the end portions 216 being offset from a center point of the central portion 218. The end portions 216 are sized so as to fit through the left and right axle openings formed in the undercarriage base 180.

The linkage plate 220 is a generally oval-shaped member that is attached to the eccentric axle central portion 218. The linkage plate 220 is attached to the central portion through a lower part of the linkage plate 220, such that the linkage plate 202 has an upper portion that extends from the central portion 218. The upper portion of the linkage plate 220 includes an attachment hole 222 for attachment with the inner wire of the fine adjust cable 162 and an eccentric axle biasing assembly 246, as will be described in further detail below. The eccentric axle 178 is configured such that when the linkage plate 220 is disposed in an upright position, e.g., the position where the attachment hole 222 is at a maximum height, the center point of the end portions 216 is also at a maximum height.

Figure 6:
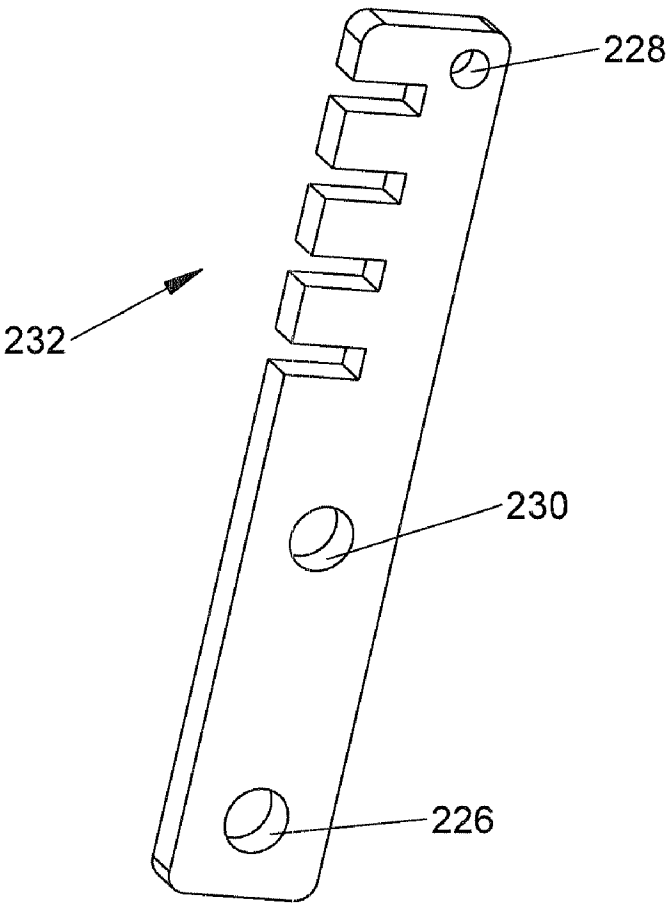
FIG. 6 is a perspective view of an adjustment plate according to the present invention.

FIG. 6 illustrates the ratcheting or adjustment plate 224. The ratcheting plate 224 is a plate member having a generally rectangular cross section with a plurality of stacked notches 232 formed therein along an engagement end of the ratcheting plate 224. An undercarriage attachment opening 226 is provided at a lower end of the ratcheting plate 224, and a biasing opening 228 is provided at an upper end of the ratcheting plate 224. Additionally, a major adjust cable attachment opening 230 is provided just above the undercarriage attachment opening 226.

Each of the horizontal notches 232 of the ratcheting plate 224 are sized so as to fit an engagement edge of the mainframe adjustment opening 150 therein. The precise number of horizontal notches 232 defined in the ratcheting plate 224 can be varied depending on the desired range of pivoting motion between the mainframe 102 and the undercarriage 104.

The saw 100 also includes a ratcheting plate biasing assembly 234 and an eccentric axle biasing assembly 246. The ratcheting plate biasing assembly 234 includes an anchor 236, a spring 238, and an attachment assembly 240. The anchor 236 is preferably a nut and bolt system that passes through the mainframe upper surface 120 with the bolt end substantially resting on the mainframe upper surface 120. A forward end of the spring 238 is secured to the anchor 236 and extends in a rearward direction toward the ratcheting plate 224. The rear end of the spring 238 is secured to the ratcheting plate 224 via the attachment assembly 240.

The attachment assembly 240 is preferably also a nut and bolt assembly secured to the ratcheting plate 224 through the biasing opening 228. As such, the bolt of the attachment assembly 240 is secured to the spring 238 and passes through the biasing opening 228, wherein the nut is tightened on the bolt. Accordingly, the top end of the ratcheting plate 224 is secured and biased by the biasing assembly 234. In this regard, the spring 238 should have a length so as to ensure that the horizontal notches 232 formed in the ratcheting plate 224 are firmly pressed against the front edge of the mainframe adjustment opening 150.

The eccentric axle biasing assembly 246 is a spring secured at one end to an inside surface of the undercarriage front wall 182 and at another end to the eccentric axle linkage plate attachment hole 222. As such, the eccentric axle biasing assembly 246 biases the linkage plate 220 in a forward direction, and consequently biases the eccentric axle 178 in a forward rotational direction.

The assembly and operation of the saw 100 is shown by and will be described with reference to FIGS. 3A-4C and 7A-7C. Therein, the undercarriage 104 is pivotally attached to the mainframe 102 by aligning the undercarriage pivot plate 190 with the mainframe pivot plates 146 such that the undercarriage pivot opening 191 is aligned with the mainframe pivot openings 148. A pivot pin 242, such as a bolt, is then passed through the pivot openings 191, 148 so as to pivotally secure the mainframe 102 to the undercarriage 104. The pivot pin 242 is therein secured, such as through the use of a nut.

Further, the ratcheting plate 224 that is secured to the mainframe 102 via the biasing assembly 234 is rotatably or pivotally secured to an outer front portion of the undercarriage left wall 186. Specifically, a bolt is passed through the undercarriage attachment opening 226 formed through the ratcheting plate 224 and through a plate attachment opening 244 defined through the undercarriage left wall 186 and loosely secured by a nut. As such, the ratcheting plate 224 can rotate about the securing point with the undercarriage 104.

The inner wire of the major adjust cable 158 is then threaded through and secured to the major adjust cable attachment opening 230. As mentioned above, the sheathing of the major adjust cable 158 is fixedly secured to the underside of the mainframe upper surface 120. Accordingly, when the major adjust cable 158 inner wire is pulled by the major adjust lever 156, the major adjust cable 158 inner wire pulls on the ratcheting plate 224. The major adjust cable 158 should be positioned such that the pulling force of the inner wire of the major adjust cable 158 exerts a sufficient pulling force on the ratcheting plate 224 to overcome the biasing force exerted on the ratcheted plate 224 in a forward direction by the biasing assembly 234.

As such, the major adjust cable 158 is operable to pull the ratcheting plate 224 backwards such that the front edge of the mainframe adjustment opening 150 is no longer received in any of the ratcheting plate horizontal notches. Accordingly, the operator can adjust the relative pivot of the mainframe 102 relative to the undercarriage 104, and upon releasing the major adjust lever 156, the ratcheted plate 224 will move forward due to the biasing force exerted by the biasing assembly 234. When the ratcheted plate 224 moves forward, one of the ratcheted plate horizontal notches 232 will engage and receive the front edge of the mainframe adjustment opening 150, thereby securing the set pivot level of the mainframe 102 relative to the undercarriage 104.

The fine adjust cable 162 is also attached by the sheathing to an undersurface of the mainframe upper surface 120. The inner wire of the fine adjust cable 162 extends from the outer sheathing and is threaded through and secured to the eccentric axle linkage plate attachment hole 222. Accordingly, the fine adjust cable 162 can pull the linkage plate 220 in a rearward direction when the fine adjuster 160 is pulled, thereby rotating the eccentric axle 178. The inner wire of the fine adjust cable 162 and the eccentric axle biasing assembly 246 cooperate with one another such that when the fine adjuster rod 170 is pushed fully downward in the housing 168, the linkage plate 178 of the eccentric axle 178 sits in an upright position, where the linkage plate attachment hole 222 and the center point of the eccentric axle end portions 216 are at their highest position.

Figure 7A:
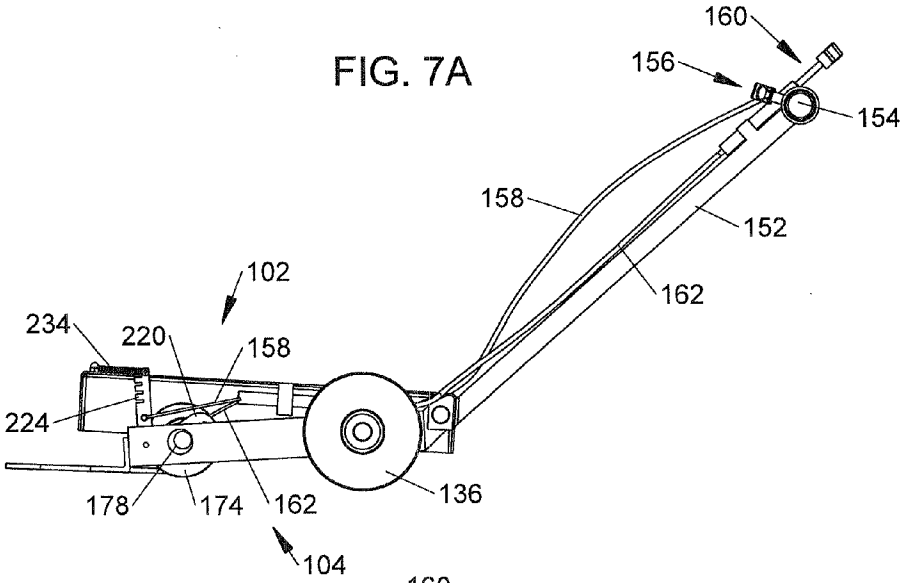
FIG. 7A is a sectional view of the mainframe and undercarriage according to the present invention in a fully elevated position.

In operation, a first state of the saw 100 is shown in FIG. 7A. Therein, the mainframe 102 is maximally pivoted relative to the undercarriage 104 so as to form the largest possible angle, and the eccentric axle 178 is positioned such that the linkage plate 220 is maximally pulled in a rearward direction, such that the front wheels 174, 176 are maximally lowered relative to the ground, which corresponds to a maximal elevation of the blade 110 using the fine adjust. This position corresponds to the lowermost horizontal notch 232 of the ratcheting plate 224 having the front edge of the mainframe adjustment opening 150 received therein. Further, the fine adjuster rod 170 is pulled fully upwards relative to the housing 168, such that the linkage plate 220 is pulled to sit in a maximally rearward position by the eccentric axle biasing assembly 246.

To achieve a major adjust of the saw blade 110 relative to the ground, the operator operates the major adjust lever 156. When the major adjust lever 156 is pulled toward the handle bar 154, the inner wire of the major adjust cable 158 is pulled upon. The pulling of the inner wire of the major adjust cable 158 causes the inner wire to pull in a rearward direction on the ratcheting plate 224. The pulling of the major adjust cable 158 overcomes the forward biasing force of the ratcheted plate biasing assembly 234, and pulls the ratcheted plate 224 in a rearward direction such that none of the horizontal notches 232 of the ratcheted plate 224 are engaged with the front edge of the mainframe adjustment opening 150.

Figure 7B:
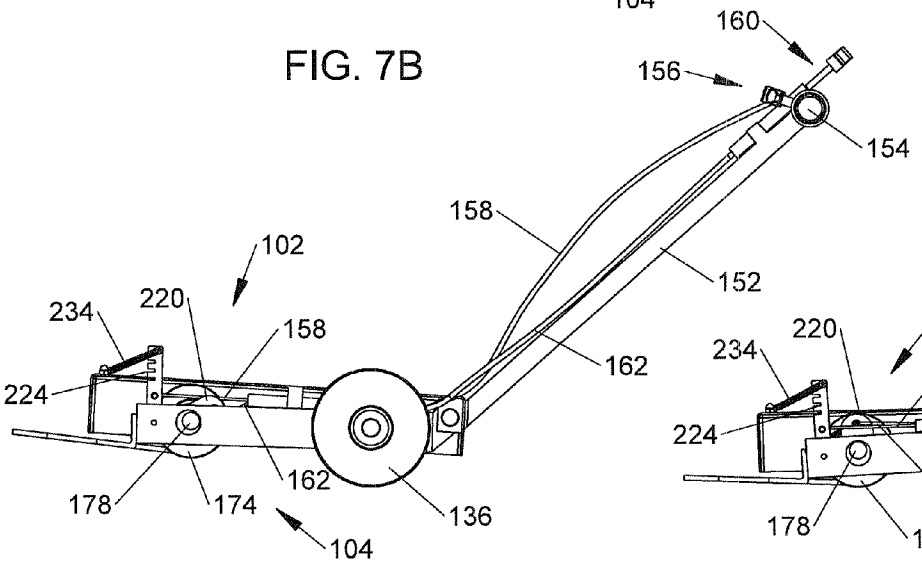
FIG. 7B is a sectional view of the mainframe and undercarriage according to the present invention in a medium elevated position.
Figure 7C:
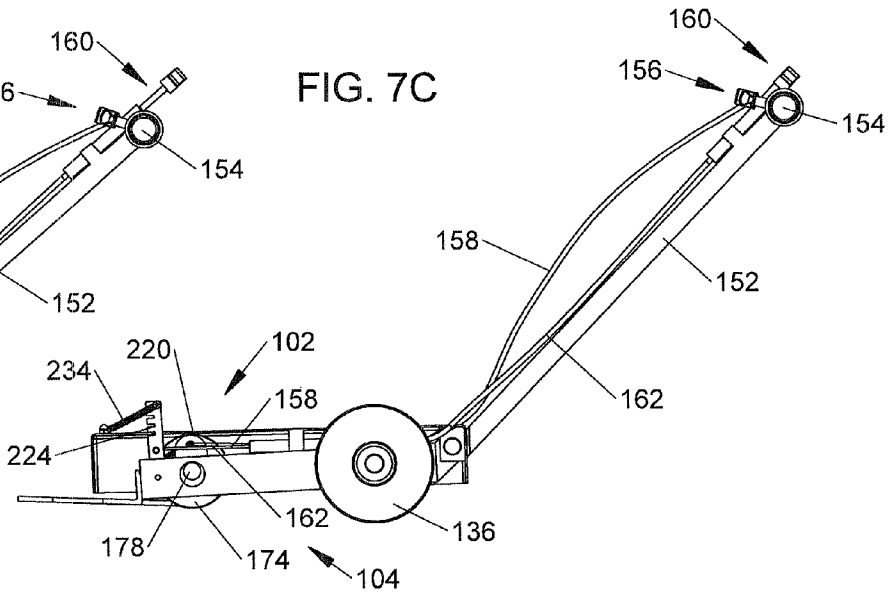
FIG. 7C is a sectional view of the mainframe and undercarriage according to the present invention in a fully lowered position.

Accordingly, by pressing downward or pulling upward on the handle bar 154, the operator can change the relative pivot of the mainframe 102 relative to the undercarriage 104 about the pivot pin 242 received in the pivot holes 148, 191 of the pivot plates 146, 190. Once the mainframe 102 is in a desired pivotal position relative to the undercarriage 104, the operator then releases the major adjust lever 156. The biasing force of the ratcheted plate biasing assembly 234 pulls the ratcheted plate 224 in a forward direction such that a horizontal notch 232 of the ratcheted plate 224 will receive the front edge of the mainframe adjustment opening 150. By using a horizontal notch 232 above the lowermost horizontal notch 232 (the notch used in FIG. 7A), a lowering of the blade 110 via the major adjust is achieved, as shown in FIG. 7B.

Once the major adjust is performed, the saw 100 allows the operator to further perform a fine adjust operation. The fine adjust operation allows for more precise setting of the blade 110 height relative to the ground. The fine adjust is performed by the operator through use of the fine adjuster 160. Specifically, to lower the blade 110, the fine adjuster rod 170 is pushed in a downward direction so as to be pushed further into the housing 168.

As the rod 170 is pushed downward, the inner wire of the fine adjust cable 162 is slacked. Accordingly, the eccentric axle biasing assembly 246 pulls the eccentric axle linkage plate 220 in a forward direction so as to approach a fully upright position, thereby rotating the eccentric axle end portions 216. When fully upright, the eccentric axle end portions 216 sit higher relative to the ground, thereby lowering the front end of the undercarriage 104 relative to the ground. Accordingly, the blade 110 is lowered relative to the ground.

Conversely, to raise the undercarriage 104 and the blade 110 from the ground, the rod 170 is pulled out of the housing 168. As the rod 170 is pulled, the inner wire of the fine adjust cable 162 pulls on the eccentric axle linkage plate 220 so as to pull the linkage plate 220 in a rearward direction. As the linkage plate 220 is pulled in a rearward direction, the eccentric axle 178 is rotated, causing the center points of the eccentric axle end portions 216 to approach the ground. As the front wheels 174, 176 are mounted on the eccentric axle end portions 216, the front end of the undercarriage 104, which is secured to the front wheels 174, 176, is thereby caused to sit further from the ground. Since the ratcheting plate 224 is secured to the front end of the undercarriage 104, as the undercarriage 104 front end is raised, the ratcheting plate 224 and the mainframe 102 are raised. As the mainframe 102 is raised, the blade 110 is raised.

Accordingly, the fine adjust allows for a height adjustment of the blade 110 along a smaller scale on a continuum. As the rod 170 can be locked in any position relative to the housing 168, the fine adjust allows for smaller or finer increments than that allowed by the major adjust through the ratcheted plate 224. Once the operator finds the desired position through the fine adjust, the operator then rotates the fine adjust handle 172 to lock the vertical position of the rod 170 relative to the housing 168. Accordingly, the fine adjust of the blade 110 height is locked in.

It is noted that since both the major adjust cable 158 and the fine adjust cable 162 are connected to biased elements (the ratcheting plate 224 and the eccentric axle linkage plate 220), the major adjust lever 156 and the fine adjuster 160 return to a base position upon release. That is, when the operator releases the major adjust lever 156, the ratcheting plate biasing assembly 234 pulls the ratcheting plate 224 forward, thereby pulling the major adjust cable 158 forward, causing the major adjust lever 156 to move away from the handle bar 154. Similarly, when the rod 170 is unlocked and released relative to the housing 168, the eccentric axle biasing assembly 246 pulls the eccentric axle forward until the rod 170 is maximally received in the housing 168 and the linkage plate 220 is fully upright.

In summary, the saw 100 allows for a major adjust of the blade 110 height and for a fine adjust of the blade 110 height. The major adjust is accomplished by changing the angle of the mainframe 102 relative to the undercarriage 104 using the ratcheted plate 224.

The fine adjust is accomplished by changing the height of the front end of the undercarriage 104 relative to the ground using the eccentric axle 178. However, in addition to the above described structure, the major adjust and minor adjust can be accomplished in other ways.

Figure 8:
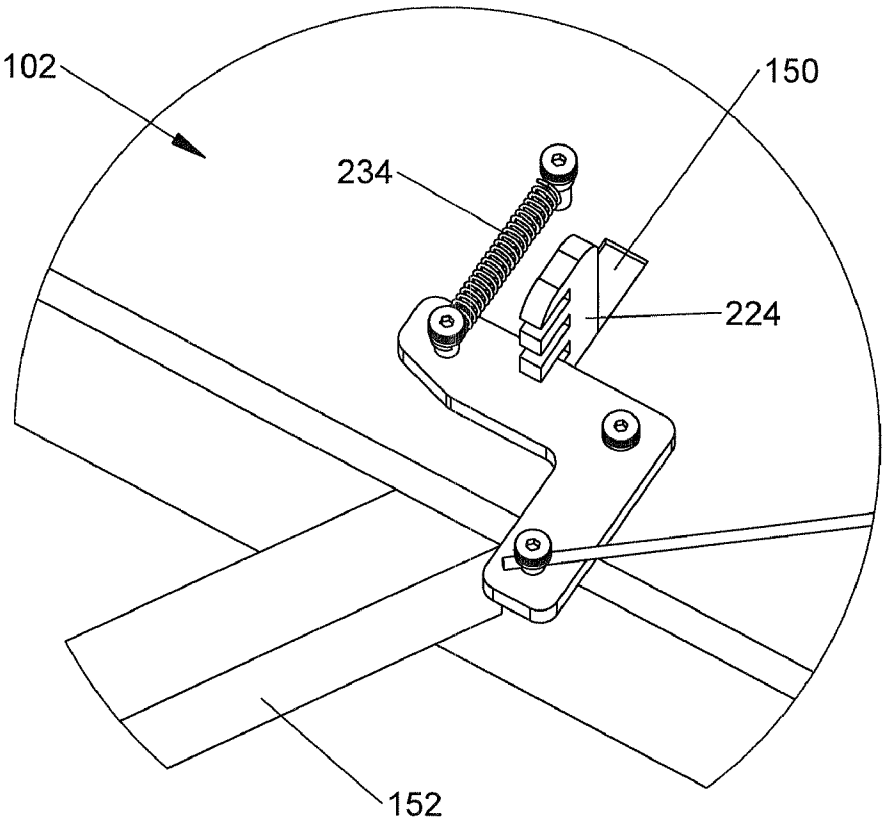
FIG. 8 is a perspective view of a mainframe and undercarriage of the green concrete saw according to the present invention with the adjustment plate disposed in an alternate position.

An example of an alternative mechanism for the major adjust is shown in FIG. 8. Therein, the mainframe 102 and the undercarriage 104 are not pivotally secured to one another. Rather, to effectuate the major adjust, the height of the mainframe 102 relative to the undercarriage is adjusted. This is done via the ratcheted plate 224 which is set at a rear of the mainframe 102 and undercarriage 104, rather than at the front of the mainframe 102 and undercarriage 104. The interconnection of the mainframe 102, the undercarriage 104, the ratcheted plate 224 and the major adjust lever 156 and major adjust cable 158 is otherwise the same.

Preferably, the mainframe 102 is mounted on the undercarriage 104 so as to be biased in an upward direction. As such, the operator can disengage the ratcheted plate 224 from the mainframe 102, and either let the biasing force elevate the mainframe 102, or step down on the mainframe 102 so as to overcome the biasing force and lower the mainframe 102.

An example of an alternative fine adjust would be arranging the eccentric axle such that the center point of the end portions is at a low position when the linkage plate attachment opening is at a high point (the upright position). As such, when the eccentric axle is rotated, the undercarriage will be lowered relative to the ground.

In addition to the above modification, it is considered apparent that the present invention is capable of numerous modifications, substitutions, and rearrangement of parts without departing from the scope and spirit of the present invention. Therefore, the invention is not limited to the particular preferred embodiment described herein, but rather is only defined by the claims appended hereto.

What is claimed is:

1. A green concrete saw comprising:

an undercarriage, a mainframe mounted on the undercarriage, the mainframe supporting a circular saw blade, a major adjust assembly including a ratcheting plate rotatably secured at a bottom end to the undercarriage and having a plurality of horizontal notches that are vertically stacked relative to one another defined in an engagement side thereof, selectively directly engaged by the mainframe and configured to adjust a height of the circular saw blade relative to the ground by adjusting a position of the mainframe relative to the undercarriage, a ratcheting plate biasing assembly, a fine adjust assembly including an eccentric axle, rotation of the eccentric axle adjusting the height of the circular saw blade relative to the ground by adjusting a relative elevation of the undercarriage from the ground, and a control assembly including a major adjust lever connected to the ratcheting plate via a major adjust cable;

wherein the notches in the ratcheting plate are sized to receive an engagement edge of an opening defined in the mainframe, and the biasing assembly biases the horizontal notches toward the engagement edge of the opening defined in the mainframe, wherein a rear end of the mainframe is pivotally secured to a rear end of the undercarriage, and the major adjust assembly adjusts the pivot angle between the mainframe and the undercarriage, and wherein the major adjust lever is adapted such that actuation of the major adjust lever causes the major adjust cable to pull the ratcheting plate away from the engagement edge of the opening defined in the mainframe.

2. The green concrete saw according to claim 1, wherein the undercarriage supports a plurality of wheels, and the eccentric axle is rotated to adjust the elevation of the undercarriage relative to wheels mounted thereon, wherein the eccentric axle has a central portion and end portions formed on opposite ends of the central portion with front wheels mounted on the end portions, wherein the end portions have a first center point and the central portion has a second center point that is different from the first center point.

3. The green concrete saw according to claim 2, wherein the eccentric axle further includes a linkage plate integrally formed therewith that radially projects from the eccentric axle central portion, and the fine adjust assembly further includes a fine adjuster and a fine adjust cable that connects the fine adjuster to the linkage plate of the eccentric axle, wherein actuation of the fine adjuster causes the fine adjust cable to pull on the linkage plate so as to rotate the eccentric axle.

4. The green concrete saw according to claim 3, wherein the fine adjuster comprises:

a rod having a handle at a first end and secured to the fine adjust cable at a second end; and a housing in which the rod is received, wherein the rod is actuated by pulling.

5. The green concrete saw according to claim 4, wherein the fine adjust assembly further includes an eccentric axle biasing member that is secured to the linkage plate and biases the linkage plate in a direction opposed to a pulling direction of the fine adjust cable.

6. The green concrete saw according to claim 5, wherein the housing includes a locking member for locking the rod in a position relative to the housing.

7. A green concrete saw comprising:

an undercarriage supporting a plurality of wheels, a mainframe mounted on the undercarriage, the mainframe supporting a circular saw blade, a major adjust assembly including a ratcheting plate selectively directly engaged by the mainframe and configured to adjust a height of the circular saw blade relative to the ground by adjusting a position of the mainframe relative to the undercarriage, and a fine adjust assembly including an eccentric axle, having a central portion with a linkage plate integrally formed therewith that radially projects from the eccentric axle central portion, and end portions formed on opposite ends of the central portion with front wheels mounted on the end portions, the end portions having a first center point and the central portion having a second center point that is different from the first center point, and a fine adjuster and a fine adjust cable that connects the fine adjuster to the linkage plate of the eccentric axle;

wherein actuation of the fine adjuster causes the fine adjust cable to pull on the linkage plate so as to rotate the eccentric axle, rotation of the eccentric axle adjusting the height of the circular saw blade relative to the ground by adjusting a relative elevation of the undercarriage from the wheels.

8. The green concrete saw according to claim 7, wherein the fine adjuster comprises:

a rod having a handle at a first end and secured to the fine adjust cable at a second end; and a housing in which the rod is received, wherein the rod is actuated by pulling.

9. The green concrete saw according to claim 8, wherein the fine adjust assembly further includes an eccentric axle biasing member that is secured to the linkage plate and biases the linkage plate in a direction opposed to a pulling direction of the fine adjust cable.

10. The green concrete saw according to claim 9, wherein the housing includes a locking member for locking the rod in a position relative to the housing.

* * * * *